United States Patent [19]

Gandhi

[11] 4,368,472

[45] Jan. 11, 1983

[54] MICROWAVE DOSIMETER

[75] Inventor: Om P. Gandhi, Salt Lake City, Utah

[73] Assignee: Dosimeter Corporation of America, Cincinnati, Ohio

[21] Appl. No.: 195,138

[22] Filed: Oct. 8, 1980

[51] Int. Cl.[3] ..... H01Q 1/22

[52] U.S. Cl. ..... 343/718; 343/895

[58] Field of Search ..... 343/718, 703, 895, 894, 343/5 PD; 250/369, 388; 324/95

[56] References Cited

U.S. PATENT DOCUMENTS 3,130,368 4/1964 Hoover ..... 343/703

3,783,448 1/1974 Brodwin ..... 343/703

OTHER PUBLICATIONS

Durney, C. H., "Electromagnetic Dosimetry for Models of Humans and Animals: A Review of Theoretical and Numerical Techniques", Poc. IEEE vol. 68, 1980, pp. 33–40.

*Primary Examiner*—David K. Moore

*Attorney, Agent, or Firm*—Wood, Herron & Evans

[57] ABSTRACT

A method and apparatus adapted to be worn by the user for measuring radio frequency (RF) and microwave energy absorbed by a person's body in the frequency range in which substantial reflection by the body normally occurs. Included is a broad band body-mounted antenna responsive to the frequency range of interest, a detector, and integrator for providing a signal correlated to the energy absorbed during a predetermined interval by the body of the user on which the antenna is mounted. Also included is a radiation absorber located between the antenna and the user's body. The absorber provides at least 3db attenuation for incident energy in the frequency range of interest for minimizing energy reflected by the user's body toward the antenna. This, in turn, minimizes measurement errors due to location of the antenna in close proximity to the body which has substantial energy-reflecting properties at microwave frequencies of interest. Also minimized are the errors due to changes in the inherent sensitivity of the antenna due to proximity to the user's body.

14 Claims, 4 Drawing Figures

MICROWAVE DOSIMETER

This invention relates to dosimetry, and more particularly, to a method and apparatus for measuring the amount of radio frequency (RF) and microwave energy in the frequency range where substantial body reflection occurs which is absorbed by a person during a specific time interval.

For a considerable period it has been known that unwanted microwave radiation incident on the body is absorbed, causing body heating, fatigue, hyperactivity, and hormone change. Individuals in a variety of environments are subjected to unwanted microwave radiation from a variety of sources such as microwave ovens, RF sealers, radio and television equipment, and the like. Depending upon the proximity of the microwave source to an individual upon which the radiation is incident, the radiation is considered either "near-field" or "far-field". Both types are potentially dangerous. As such, it is desirable to continuously monitor both near-field and far-field radiation absorbed by an individual. The resulting microwave dosage information enables health hazards to be assessed and the deleterious effects of overdoses avoided.

Although the prior art suggests the construction of various devices adapted to be worn by the user for monitoring microwave power density, none have been found to be satisfactory. The principal deficiency of the prior art proposals is the unreliability of the power density measurement. In some cases, a body-mounted "dosimeter" of a particular prior art construction will indicate an inordinately high measurement, for example, three or four times the actual power density, while in other cases the same "dosimeter" will indicate a measurement approaching zero.

A dosimeter ought to give an estimate of the absorbed dose which is not simply related to the power density, but varies a great deal depending upon the orientation of the electric field and/or the user relative to it, the frequency of microwaves, etc. None of the prior art devices, in spite of the title "dosimeter" have gone beyond the power density measurement.

Accordingly, it has been an objective of this invention to provide a microwave dosimeter adapted to be conveniently mounted on the body of the user which reliably measures the bodily-absorbed radiation, both near-field and far-field, in the frequency range in which substantial body reflection of incident energy occurs. This objective has been accomplished in accordance with certain of the principles of this invention by providing a dosimeter which includes a broad band antenna responsive to those components of the electric field of the incident microwave radiation which lie in a plane generally parallel to the body on which the radiation is incident, a detector responsive to the antenna for converting the energy received by the antenna into a unidirectional voltage having a magnitude correlated to the amount of received energy, isolating means located between the antenna and the user's body when the antenna is mounted thereon for preventing radiation directed toward the body from being reflected therefrom to the antenna, computing means responsive to the detector for providing a signal correlated to the dose or the power absorbed by the body in the frequency range in which substantial body reflection occurs, and indicating means responsive to the computing means to provide a humanly perceptible output correlated to the energy absorbed by the body in the frequency range in which substantial body reflection occurs. In a preferred form of the invention, the isolating means located between the antenna and the user's body includes an absorber constructed to provide at least a 3 db transmission loss for energy incident thereon in the frequency range of interest, that is, in the frequency range in which substantial body reflection occurs. A particularly satisfactory absorber has been found to be a generally planar slab containing ferrite configured substantially coextensive with the antenna having a thickness of approximately 0.5–1 cm. Preferably, the edges of the slab-shaped absorber are bevelled to minimize reflection of energy therefrom toward the antenna.

By reason of the inclusion of the energy-absorbing isolating slab between the antenna and the user's body, incident radiation transmitted toward the user's body which is not captured by the antenna is not reflected by the body back toward the antenna, which if permitted to occur, could increase or decrease substantially the measurement depending on whether the reflected radiation is in-phase or out-of-phase with the incident radiation. Also minimized are the errors due to changes in the inherent sensitivity of the antenna due to proximity to the user's body.

In accordance with a further aspect of the invention, a very unobvious and advantageous method is provided for calibrating the dosimeter to accommodate both the specific location of the dosimeter on the user's body and the specific electric field distribution of the microwave energy in the region of the user. More specifically, and in accordance with this method, the body is divided into a plurality of different vertical energy-density measuring zones 1, 2,–N. Using the dosimeter of this invention, the energy incident on each zone $E_1^2$, $E_2^2$,–$E_N^2$ is separately measured. This is accomplished by temporarily placing the dosimeter without the absorber pad in each of the previously defined zones with the user having moved out of the region to minimize reflection of energy from the body to the antenna. The separate incident energy-density measurements for each zone $E_1^2$, $E_2^2$,–$E_N^2$ taken at the detector output are then averaged, providing an average incident energy $\overline{E^2}$ for the entire body. The dosimeter is then permanently mounted to the user's body in one of the zones 1, 2,–N with the energy absorber between the user's body and the antenna. With the dosimeter permanently mounted, the instantaneous detected output of the antenna $E_i^2$ is corrected, by multiplying by the factor $(\overline{E^2}/E_i^2)$ to compensate for the difference between the average energy density throughout all zones of the body $\overline{E^2}$ and the energy density $E_i^2$ at the specific zone i whereat the antenna is now permanently located. The corrected detected antenna output $$\left(\frac{\overline{E^2}}{E_i^2}\right).$$

$E_i^2$ correlated to incident energy is then used to compute the energy currently being absorbed collectively by all zones of the body and a humanly perceptible indication thereof provided.

These and other features, objectives and advantages of the invention will become more readily apparent from a detailed description thereof taken in conjunction with the drawings in which.

Figure 2:
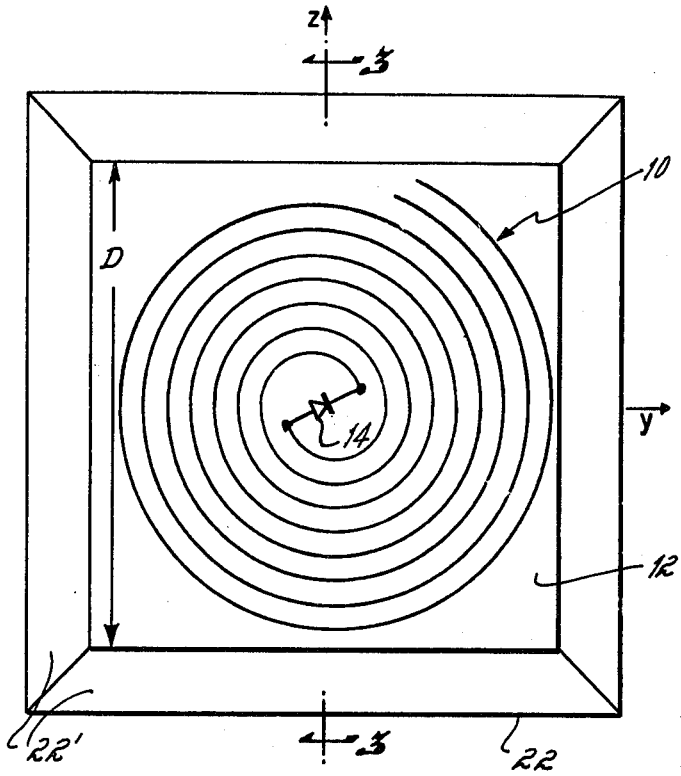
FIG. 2 is a front elevational view of the antenna, diode detector, and antenna-body isolating element.
Figure 3:
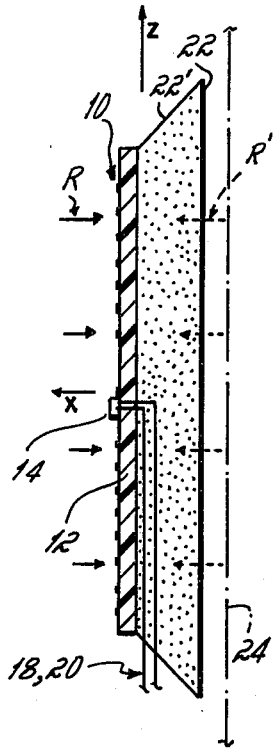
FIG. 3 is a side elevational view of the antenna, diode detector, and isolating element.

With reference to FIGS. 2 and 3, a microwave personnel dosimeter is shown of a type adapted to be worn by a user for monitoring microwave radiation absorbed by a user over the frequency range wherein substantial reflection by the body normally occurs, namely, the range principally including 0.5–26 GHz. The dosimeter includes a radiation sensor in the form of a broad band antenna 10 selected to have a reasonably uniform response to incident microwave radiation in the frequency range of interest, namely, the frequency range principally including 0.5–26 GHz over which substantial reflection thereof by the human body normally occurs. An antenna 10 of the equiangular spiral type is preferred because of its flat, compact configuration which facilitates convenient packaging. However, any antenna can be used providing it exhibits the desired response characteristic over the microwave frequency range of interest. In the preferred embodiment, the spiral antenna 10 having a diameter D of approximately 6.5 cm. is formed by printed circuit techniques on a dielectric substrate of printed circuit board 12 of generally square configuration measuring approximately 6.5 cm. on each edge. Of course, as those skilled in the art understand, the diameter D of the spiral antenna is designed to be responsive, with the diameter increasing as the frequency decreases.

The spiral antenna 10 of the preferred embodiment has a generally conical envelope of uniform response symmetrical to the X axis throughout an included angle of approximately 90°. The spiral antenna 10 has negligible response to the electric field intensity component $E_x$ parallel to the X axis. However, since the electric field intensity component $E_x$ parallel to the X axis penetrates the human body to only a negligible extent, in the 0.5–26 GHz range, measurement of this component can be safely ignored without appreciable dose, or body absorption, error in this frequency range.

The dosimeter also includes a detector 14, preferably a Schottky diode, connected to the antenna for converting the AC signal received by the antenna 10 to a substantially unidirectional, or DC, voltage. The detector output is taken out via a pair of high resistance wire leads 18, 20 having a resistance of 50–100K ohms/cm.

Assuming the antenna 10 lies in the Y-Z plane, the output voltage V of the diode detector 14 across lines 18 and 20 has a component $V_y$ and component $V_z$. Detector output voltage components $V_y$ and $V_z$, by reason of the square law detection characteristics of the diode detector 14, are correlated to the square of the electric field intensity components parallel to the Y and Z axes, $E_y^2$ and $E_z^2$, respectively, by a factor of K, where K is a proportionality constant determined by antenna efficiency, diode loss, lead wire loss, etc.

A further and critically important element of the dosimeter of this invention is an isolator 22 which, when the dosimeter is attached to the user's body, is located between the antenna 10 and the adjacent surface 24 of the user's body shown schematically in dotted lines. For example, if the generally planar antenna 10 is inserted in the user's shirt pocket parallel to his chest surface 24, the isolator 22 is located between the chest wall and the antenna-mounting substrate 12. The isolator 22 serves the very important function of preventing, or at least substantially reducing, radiation R propagating toward the antenna 10 along the X axis from being reflected by the user's body 24 back toward the antenna as reflected radiation R'. By eliminating reflections R' from the user's body 24 toward the antenna 12, inaccuracies are avoided.

For example, if incident radiation R were to be reflected from the chest wall 24 back toward the antenna 10 and such reflected radiation R; were in phase with the incident radiation R, constructive interference results and the output of the detector 14 across lines 18 and 20 is unduly high. Under conditions of maximum constructive interference between reflected radiation R' and incident radiation R, the output of the diode detector, due to its square law detection characteristics, can be erroneously high by a factor of 4. Alternatively, if reflected radiation R' were to occur and were to be out of phase with the incident radiation R, destructive interference occurs with the result that the output of the diode detector could, as a limit, approach zero for the condition of maximum phase shift of 180° between the incident radiation R and the reflected radiation R'.

In a preferred form of the invention the isolator 22 takes the form of a slab of ferrite-containing material having a rectangular shape conforming to that of the substrate 12 on which the spiral antenna 10 is mounted. The thickness of the isolator 22 measured along the X axis, taken in combination with the absorption characteristics of the isolator material over the frequency range of interest, should be such as to attenuate transmission of radiation through the isolating slab in one direction a minimum of approximately 3 db, with attenuation of 5–10 db being preferred. With a reduction in transmission through the isolator 22 in a single direction being in the range of 3–10 db, a total transmission reduction of 6–20 db occurs due to the fact that radiation R passing through the antenna 10 toward the chest wall 24 traverses through the isolator 22 twice in the course of reaching the chest wall and thereafter being reflected therefrom.

Ferrite is the preferred material for the isolator 22 because it minimizes isolator thickness, e.g., approximately 0.5–1.0 cm. However, other materials may be used, assuming appropriate thickness, to provide the desired degree of attenuation or absorption of radiation in the frequency range of interest wherein substantial reflection by the human body normally occurs. Illustrative of such materials are ferrite-epoxy, ferrite-silicone, ferrite-urethane-epoxy, silicone rubber, etc., all of which are commercially available.

The edges 22' of the isolator slab 22 are preferably bevelled to minimize reflection of incident radiation R from the slab itself toward the spiral antenna 10.

Figure 1:
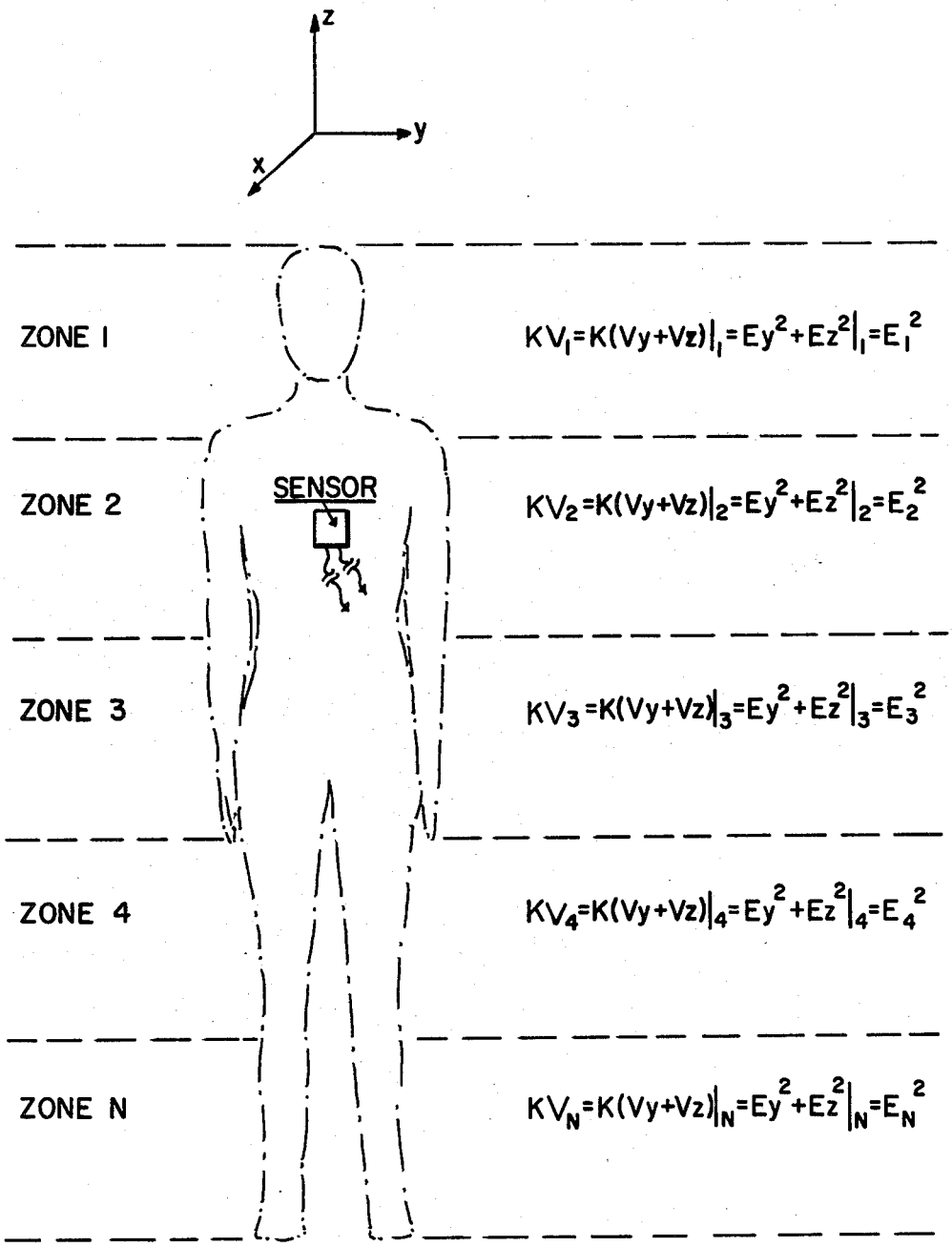
FIG. 1 is a schematic view of a user's body divided into N zones in conjunction with which is shown the equation representing the detected output of the antenna when the dosimeter is located in the respective zones 1, 2,-N, which is correlated to energy incident on each zone.

To accommodate the fact that the antenna 10 when in use is mounted at a single point on the user's body, such as in the chest region, and the further fact that microwave energy in the frequency range of interest exhibits a field distribution which varies considerably from one point to another over the surface area of the body incident with the radiation, the output $V_i$ of the detector 14 across lines 18 and 20 must be corrected or compensated. Specifically, the detector output $V_i$ must be corrected to compensate for the difference between the average energy incident over the entire area of the user's body and the average energy incident over that zone of the user's body where the antenna is mounted. To facilitate such compensation the user's body is divided into a plurality of zones, preferably disposed vertically one above the other as shown in FIG. 1. In accordance with one preferred arrangement, the body is divided, for purposes of convenience, into N zones, 1, 2, 3, 4,-N. The quantities of $E_1^2=Ey_1^2+Ez_1^2$, $E_2^2=Ey_2^2+Ez_2^2$, $E_3^2=Ey_3^2+Ez_3^3$, $E_4^2=Ey_4^2+Ez_4^2$, and $E_N^2=Ey_N^2+Ez_N^2$ are separately computed by locating the antenna 10 (with pad 22 removed) sequentially in zones 1, 2, 3, 4, and N, respectively, and measuring in each zone the detector output $V_1$, $V_2$, $V_3$, $V_4$, and $V_N$, respectively, where $$V_1 = \frac{E_1^2}{K},\ V_2 = \frac{E_2^2}{K},\ V_3 = \frac{E_3^2}{K},\ V_4 = \frac{E_4^2}{K},$$

$$\text{and } V_N = \frac{E_N^2}{K}.$$

Measurements $V_1$, $V_2$, $V_3$, $V_4$, and $V_N$ taken at the detector output are then multiplied by factor K to correct for antenna efficiency, lead loss, etc., providing $E_1^2$, $E_2^2$, $E_3^2$, $E_4^2$, and $E_N^2$ for zones 1, 2, 3, 4, N, respectively. The average $E^2$ of $E_1^2$, $E_2^2$, $E_3^2$, $E_4^2$, and $E_N^2$ is then computed in the following manner:

$$\overline{E^2} = \frac{E_1^2 + E_2^2 + E_3^2 + E_4^2 + \ldots E_N^2}{N}$$

Assuming the antenna 10 is located in zone i, and the pad 22 in place, the instantaneous output $V_i$ of the detector 14 across lines 18 and 20 is corrected for the difference between the average incident energy over the whole body, $\overline{E^2}$, and the incident energy, $E_i^2$, in zone i where the antenna is located, by multiplying it by the fraction $(\overline{E^2}/E_i^2)$. Thus, if the antenna 10 is located in zones 1, 2, 3, 4, etc., the instantaneous detector output across lines 18 and 20, $V_1$, $V_2$, $V_3$, $V_4$, etc., respectively, is corrected by multiplying by the correction factor $(\overline{E^2}/E_1^2)$, $(\overline{E^2}/E_2^2)$, $(\overline{E^2}/E_3^2)$, $(\overline{E^2}/E_4^2)$, etc., respectively.

To compute the total energy absorbed by the body $P_t$ per unit time, the following equation is used:

$$P_t = C \int_A \frac{(E_y^2 + E_z^2)\, dydz}{\eta}$$

where A=the area of the body upon which the microwave radiation R is incident, $\eta$ is the intrinsic impedance of free space, and C=the extent to which incident energy R is absorbed by the body. Assuming that all energy incident on the body is absorbed, (a worst case possibility, particularly for near-field conditions), the foregoing equation can be approximated as follows:

$$P_t \doteq \frac{\overline{E^2}A}{\eta}.$$

Further assuming the antenna 10 is located in zone i and provides at the detector output an instantaneous measurement $V_i=(E_i^2/K)$, the above approximation of total energy absorbed per unit time converts to:

$$P_t \doteq \left(\frac{\overline{E^2}}{E_i^2}\right) \cdot E_i^2 \frac{A}{\eta}.$$

If $\eta=377\Omega$ and the average frontal area of a human being is 0.45 square meters, the foregoing equation reduces to:

$$P_t \doteq \left(\frac{\overline{E^2}}{E_i^2}\right) E_i^2 \frac{0.45}{377} \text{ watts.}$$

Assuming the average person weights 70 Kg., the specific absorption rate, SAR, can be computed as follows:

$$SAR = \frac{P_t}{70} \ \frac{\text{watt}}{\text{Kg}}.$$

Figure 4:
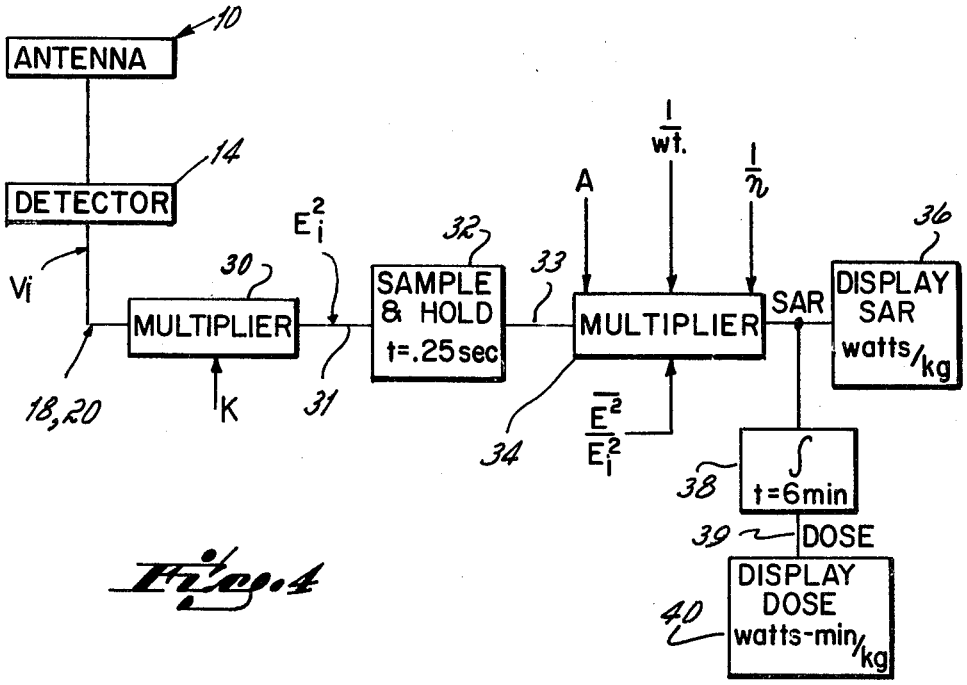
FIG. 4 is a schematic circuit in block diagram format of the electrical components of the dosimeter.

To accomplish processing the instantaneous output $V_i$ of the detector 14 located in zone i, which is present between lines 18 and 20, for the purpose of computing the specific absorption rate, SAR, and the dosage over some arbitrary interval, T, such as six minutes, the circuit of FIG. 4 is utilized. The circuit, in addition to the antenna 10 and detector 14, further includes a multiplier 30 for compensating the instantaneous detector output $V_i$ for such things as antenna efficiency, lead loss, diode losses, and the like. The instantaneous compensated detector output $E_i^2$ from the multiplier 30 is input to a sample and hold circuit 32 which samples the corrected detector output on line 31 at convenient intervals, such as every 0.25 seconds, providing sampled outputs on line 33. The sampled and corrected output of the detector 14 is input to a multiplying circuit 34 via line 33 to facilitate computation of the specific absorption rate, SAR. The inputs to the multiplier 34 correspond to (a) the area of the user's body where the area A typically equals 0.45 square meters, (b) the reciprocal of the user's weight which is typically (1/70) Kg, and (c) the reciprocal of the intrinsic impedance of free space, $\eta$, which is 1/377 ohms, and the compensation factor $(\overline{E^2}/E_i^2)$ which corrects for the difference between the average energy incident on the entire area of the user's body and the average energy incident on the particular zone i of the user's body in which the antenna is located.

The specific absorption rate, SAR, is input to a display 36 which is updated at intervals corresponding to the sample and hold interval. The specific absorption rate, SAR, in units of watts/Kg., is also input to an integrator 38 which integrates the specific absorption rate for an arbitrary interval, T, which in accordance with standards published by American National Standards Institute, is six minutes. The integrated output of the specific absorption rate over the period, T, from the integrator 38, which is present on line 39, is input to a dose display 40. The dose display 40, in units of joules/Kg., is updated at intervals corresponding to the integration period T of the integrator 38 which, in the preferred embodiment, is six minutes.

While not shown in the circuit of FIG. 4, those skilled in the art will understand that suitable amplification should be provided between the detector 14 and multiplier 30. Additionally, and while also not shown in drawings, it may be desirable to enclose the antenna 10 and detector 14 within a protective housing, such as plastic or the like, which is transmissive to radiation in the frequency range of interest, that is, in the frequency range in which substantial reflection from the body normally occurs. Also preferably included is a rechargeable Ni-Cd battery pack to allow portability of the dosimeter.

As previously noted, utilization of the isolator 22 obviates measurement errors occasioned by reflection of incident energy from the body toward the antenna. In the frequency range of interest, that is, the frequency range wherein substantial body reflection occurs, if a spiral-type antenna does not provide a substantially uniform frequency response in the entire frequency range of interest, or its size becomes unduly large at lower frequencies in the frequency range of interest, the spiral antenna can be supplemented with an antenna which does respond to those frequencies in the frequency range of interest in which the spiral type antenna is deficient. For example, at frequencies below 0.5 GHz, it may be desirable to supplement the spiral antenna with a three-element dipole antenna having three mutually perpendicular dipole receiving elements oriented to be responsive to the electrical field intensity components of incident radiation, Ex, Ey, Ez, in the X, Y, and Z directions, respectively. In this lower portion of the frequency range of interest, substantial microwave penetration of the body occurs in the X direction, and for this reason a dipole element responsive to the electrical field intensity component Ex in a direction parallel to the X axis should be provided. Of course, if a supplemental antenna is used, such as a dipole antenna, the isolating pad should be located between the dipole antenna and the user's body to avoid reflection of incident energy from the body to the dipole antenna for the same reason that it is located between the body and the spiral antenna when dosage (vis-a-vis calibration) measurements are made.

If it is desired to measure radiation in a frequency range in which substantial body reflection does not occur, the isolator should still be used to minimize the errors in the sensitivity of the antenna due to proximity to the user's body when dosage (vis-a-vis calibration) measurements are made.

The dosimeter of this invention can be used for frequencies lower than 0.5 GHz as well, providing SAR is computed as follows:

$$SAR = \frac{\frac{5.2\,L_m^2}{\mathrm{Wt/Kg}}\left(\frac{f}{fr}\right)^{2.75}\left(\frac{E_{max}^2}{(61.4)^2E_i^2}\right)\cdot E_i^2}{\left[1+\left(\frac{2.4}{\Delta_{zm}}\right)^2\right]\left[1+\left(\frac{1}{\Delta_{ym}}\right)^2\right]},\ \text{for } f \leqq fr;\ \text{and} \tag{1}$$

$$SAR = \frac{\frac{0.595}{f}\ \frac{L_m}{\mathrm{Wt/Kg}}\left(\frac{E_{max}^2}{(61.4)^2E_i^2}\right)\cdot E_i^2}{\left[1+\left(\frac{1}{\Delta_{zm}}\right)^2\right]\left[1+\left(\frac{1}{\Delta_{ym}}\right)^2\right]},\ \text{for } f > fr. \tag{2}$$

In these equations, $L_m$ is the user's height in meters which typically is 1.65–1.8 m., Wt is the user's weight in Kg, fr is the resonant frequency of the user where $fr=(0.114/L_m)$ GHz, and f is the irradiation frequency in GHz. In equation (1), $\Delta_{zm}$ is twice the distance between the points in the Z direction whereat $Ez^2=\frac{1}{2}Ez^2_{max}$, where $Ez^2_{max}$ is the square of the maximum value of Ez at any of the zones of the user. Similarly, $\Delta_{ym}$ is twice the distance between the points in the Y direction whereat $Ez^2=\frac{1}{2}Ez^2_{max}$. In equation (2), $\Delta_{zm}$ is twice the distance between the points in the Y direction whereat $Ez^2+Ey^2=\frac{1}{2}(Ez^2+Ey^2)_{max}$, where $(Ez^2+Ey^2)_{max}$ is the maximum value of the sum of $Ez^2$ and $Ey^2$ at any of the zones of the user. The foregoing empirical equations (1) and (2) for SAR have been obtained from the frequency and orientation dependent nature of the SAR in the RF range. These empirical equations can be solved by substituting a specially programmed microprocessor for the computing circuit of FIG. 4 in accordance with well known techniques.

Finally, and as previously noted, the dosimeter of this invention can be used to determine the correction factor $(E^2_{max}/Ei^2)$, similar to the survey procedure described previously. $E^2_{max}$ in equation (1) is the maximum value of $Ez^2$, while $E^2_{max}$ in equation (2) is the maximum value of $Ez^2+Ey^2$. $Ei^2$ in equation (1) is $Ez^2$ in zone i whereat the antenna is located, while $Ei^2$ in equation (2) is $Ez^2+Ey^2$ in zone i whereat the antenna is located.

Having described the invention, what is claimed is:

1. Apparatus capable of being worn by a person for providing an indication of the amount of microwave energy absorbed by a person's body at the frequencies in which substantial reflection thereof by the human body normally occurs, comprising:

an antenna at least responsive, for frequencies of microwave radiation in which substantial reflection from the human body occurs, to those components of the electric field of said microwave radiation incident on a body which lie in a plane generally parallel to said body on which said radiation is incident, a detector responsive to said antenna for converting energy received by said antenna in said microwave frequency range in which substantial reflection from the human body occurs into a unidirectional voltage having a magnitude proportional to the amount of received energy, isolating means located between said antenna and said user's body when said antenna is mounted thereon for preventing radiation directed toward said body in said microwave frequency range in which substantial reflection from the human body occurs from being reflected therefrom to said antenna, computing means responsive to said detector for providing a signal correlated to the energy absorbed by said body in said frequency range in which substantial body reflection occurs, and indicating means responsive to said computing means to provide a humanly perceptible output correlated to said energy absorbed by said body in said frequency range in which substantial body reflection occurs.

2. The apparatus of claim 1 in which said isolating means includes an absorber constructed to provide at least a 3 db attenuation for energy incident thereon in said frequency range in which substantial body reflection occurs.

3. The apparatus of claim 2 in which said absorber includes a generally planar rectangular slab containing ferrite having edges each approximately 7–10 cm. in length and a thickness of approximately 0.5–1 cm.

4. The apparatus of claim 2 in which said absorber is slab-shaped and has beveled peripheral edges to minimize energy reflection therefrom toward said antenna.

5. The apparatus of claim 1 wherein said computing means includes an integrator to provide a signal correlated to the accumulated dose of radiation absorbed by said body during a predetermined interval.

6. The apparatus of claim 1 wherein said computing means includes correction means for correcting said detector output to compensate for the difference between the average energy incident on the entire area of said user's body and the average energy incident on the area of said user's body in the region whereat said antenna is mounted.

7. The apparatus of claim 4 in which said antenna is substantially planar and mounted parallel to said slab-shaped absorber.

8. The apparatus of claim 7 in which antenna is of the spiral type.

9. The apparatus of claim 1 in which said antenna is responsive to microwave energy in the approximate frequency range of 0.5–26 GHz.

10. A method of providing an indication of the amount of microwave energy absorbed by a person's body in the frequency range in which substantial reflection thereof by the human body occurs, comprising the steps of:

dividing the body into a plurality of different energy-measuring zones 1, 2,–N, separately measuring for each zone 1, 2,–N the energy incident on the body in said zone by (a) temporarily placing adjacent each zone of the body an antenna responsive to energy in a frequency range in which substantial reflection thereof by the human body occurs, said antenna not being shielded by an energy absorber located proximate thereto, (b) rectifying the energy received by said antenna in the range in which substantial body reflection occurs while in each zone, and (c) measuring the energy $E_1^2$, $E_2^2$,–$E_N^2$ incident on each body zone 1, 2,–N in response to said rectified antenna output for each zone, computing the average $E^2$ of said body zone incident energy $E_1^2$, $E_2^2$,–$E_N^2$, permanently locating an antenna responsive to said energy adjacent the body in one of said zones N with an energy absorber between said body and said antenna, and while said antenna and absorber are so located rectifying the instantaneous output $E_i^2$ of said antenna and correcting said rectified instantaneous antenna output for the difference between the average energy incident on all zones of said user's body and the energy incident on the zone i whereat said antenna is permanently located, said correcting including multiplying said rectified instantaneous antenna output by the quotient of the average incident energy $E^2$ divided by the incident energy $E_i^2$, where $E_i^2$ is the incident energy previously measured for zone N whereat the antenna is permanently located, computing, in response to said corrected rectified antenna output, the average energy absorbed by all zones of said body and providing a humanly perceptible indication thereof.

11. The method of claim 10 wherein said computing step includes integrating the average energy absorbed by all zones for an arbitrary interval to provide an output signal correlated to absorbed energy dose.

12. Apparatus capable of being worn by a person for providing an indication of the amount of microwave energy absorbed by a person's body at frequencies in which substantial reflection thereof by the human body normally occurs, comprising:

an antenna responsive, for frequencies of microwave radiation in which substantial reflection from the human body occurs, to the electric field of microwave radiation incident on a body, a detector responsive to said antenna for converting energy received by said antenna in said microwave frequency range in which substantial reflection from the human body occurs into a unidirectional voltage having a magnitude proportional to the amount of received energy, isolating means located between said antenna and said user's body when said antenna is mounted thereon for preventing radiation directed toward said body in said microwave frequency range in which substantial reflection from the human body occurs from being reflected therefrom to said antenna, computing means responsive to said detector for providing a signal correlated to the energy absorbed by said body in said frequency range in which substantial body reflection occurs, and indicating means responsive to said computing means to provide a humanly perceptible output correlated to said energy absorbed by said body in said frequency range in which substantial body reflection occurs.

13. A method of providing an indication of the amount of microwave energy absorbed by a person's body, comprising the steps of:

dividing the body into a plurality of different energy-measuring zones 1, 2,–N, separately measuring for each zone 1, 2,–N the energy incident on the body in said zone by (a) temporarily placing adjacent each zone of the body an antenna responsive to said microwave energy, said antenna not being shielded by an energy absorber located proximate thereto, (b) rectifying the energy received by said antenna in the range in which substantial body reflection occurs while in each zone, and (c) measuring the energy $E_1^2$, $E_2^2$,–$E_N^2$ incident on each body zone 1, 2,–N in response to said rectified antenna output for each zone, computing the average $\overline{E^2}$ of said body zone incident energy $E_1^2$, $E_2^2$,–$E_N^2$, permanently locating an antenna responsive to said energy adjacent the body in one of said zones N with an energy absorber between said body and said antenna, and while said antenna and absorber are so located rectifying the instantaneous output $E_i^2$ of said antenna and correcting said rectified instantaneous antenna output for the difference between the average energy incident on all zones of said user's body and the energy incident on the zone i whereat said antenna is permanently located, said correcting including multiplying said rectified instantaneous antenna output by the quotient of the average incident energy $E^2$ divided by the incident energy $E_i^2$, where $E_i^2$ is the incident energy previously measured for zone N whereat the antenna is permanently located, computing, in response to said corrected rectified antenna output, the average energy absorbed by all zones of said body and providing a humanly perceptible indication thereof.

14. The method of claim 13 wherein the energy includes frequencies below 500 MHz, and the antenna is responsive to energy below 500 MHz.

* * * * *

UNITED STATES PATENT AND TRADEMARK OFFICE

CERTIFICATE OF CORRECTION

PATENT NO. : 4,368,472

DATED : January 11, 1983

INVENTOR(S) : Om P. Gandhi

It is certified that error appears in the above-identified patent and that said Letters Patent are hereby corrected as shown below:

Column 2, line 34, "1, 2,-N" should be -- 1, 2, . . . N --.

Column 2, line 35, "$E_2{}^2$,-$E_N{}^2$" should be -- $E_2{}^2$, . . . $E_N{}^2$ --.

Column 2, line 42, "$E_2{}^2$,-$E_N{}^2$" should be -- $E_2{}^2$, . . . $E_N{}^2$ --.

Column 2, line 45, "1, 2,-N" should be -- 1, 2, . . . N --.

Column 3, line 5, "1, 2,-N" should be -- 1, 2, . . . N --.

Column 5, line 11, "3, 4,-N" should be -- 3, 4, . . . N --.

Column 5, line 11, delete the word "of" after "quantities".

Column 5, line 29, "$E^2$" should be -- $\overline{E^2}$ -- .

Column 5, line 45, "$(\overline{E^2}/E_1{}^2)$, $(\overline{E^2}/E_2{}^2)$, $(\overline{E^2}/E_3{}^2)$, $(\overline{E^2}/E_4{}^2)$ should be -- $(\overline{E^2}/E_1{}^{2'})$, $(\overline{E^2}/E_2{}^{2'})$, $(\overline{E^2}/E_3{}^{2'})$, $(\overline{E^2}/E_4{}^{2'})$ --.

Column 5, line 50, After "$P_t$ = C" insert $\iint$ above "A".

Column 6, line 5, After the righthand bracket, delete ".".

Column 9, line 27, "1, 2,-N" should be -- 1, 2, . . . N --.

Column 9, line 28, "1, 2,-N" should be -- 1, 2, . . . N --.

UNITED STATES PATENT AND TRADEMARK OFFICE

CERTIFICATE OF CORRECTION

PATENT NO. : 4,368,472

DATED : January 11, 1983

INVENTOR(S) : Om P. Gandhi

It is certified that error appears in the above-identified patent and that said Letters Patent is hereby corrected as shown below:

Column 9, line 39, "$E_2^2,-E_N^2$" should be -- $E_2^2, \ldots E_N^2$ --.

Column 9, line 40, "1, 2,-N" should be -- 1, 2, . . . N --.

Column 9, line 42, "$E^2$" should be -- $\overline{E^2}$ --.

Column 9, line 43, "$E_2^2,-E_N^2$" should be -- $E_2^2, \ldots E_N^2$ --.

Column 9, line 55, "$E^2$" should be -- $\overline{E^2}$ --.

Column 10, line 32, "1, 2,-N" should be -- 1, 2, . . . N --.

Column 10, line 33, "1, 2,-N" should be -- 1, 2, . . . N --.

Column 10, line 41, "$E_2^2,-E_N^2$" should be -- $E_2^2, \ldots E_N^2$ --.

Column 10, line 42, "1, 2,-N" should be -- 1, 2, . . . N --.

Column 10, line 45, "$E_2^2,-E_N^2$" should be -- $E_2^2, \ldots E_N^2$ --.

Column 10, line 58, "$E^2$" should be -- $\overline{E^2}$ --.

Signed and Sealed this

*Fifteenth* Day of *November 1983*

[SEAL]

*Attest:*

GERALD J. MOSSINGHOFF

*Attesting Officer* *Commissioner of Patents and Trademarks*